US009388833B2

(12) United States Patent
Zajac, Jr. et al.

(10) Patent No.: US 9,388,833 B2
(45) **Date of Patent: *Jul. 12, 2016**

(54) COMPACT LINEAR ACTUATOR WITH ANTI-ROTATION DEVICE

(71) Applicant: ZAYTRAN, Inc., Elyria, OH (US)

(72) Inventors: Theodore Stanley Zajac, Jr., Avon Lake, OH (US); David Moore Zajac, Avon Lake, OH (US); Steven Eric Wallace, Sheffield Lake, OH (US); Cory David Trent, Elyria, OH (US)

(73) Assignee: Zaytran, Inc., Elyria, OH (US)

( * ) Notice: Subject to any disclaimer, the term of this patent is extended or adjusted under 35 U.S.C. 154(b) by 466 days.

This patent is subject to a terminal disclaimer.

(21) Appl. No.: 13/869,361

(22) Filed: Apr. 24, 2013

(65) Prior Publication Data

US 2013/0269517 A1 Oct. 17, 2013

Related U.S. Application Data

(63) Continuation-in-part of application No. 13/447,411, filed on Apr. 16, 2012, now Pat. No. 9,080,583.

(51) Int. Cl.
*F15B 15/18* (2006.01)
*F15B 15/14* (2006.01)

(52) U.S. Cl.
CPC ..... *F15B 15/1419* (2013.01)

(58) Field of Classification Search
CPC ... F15B 15/1419; F15B 16/1414; F02F 3/022
USPC ..... 92/165 R
See application file for complete search history.

(56) References Cited

U.S. PATENT DOCUMENTS

| | | | | |
|---|---|---|---|---|
| 3,180,236 | A * | 4/1965 | Beckett | F15B 15/1414 277/438 |
| 5,974,948 | A | 11/1999 | Thompson et al. | |
| 6,931,982 | B1 * | 8/2005 | Zajac, Jr. | F15B 15/1414 92/165 PR |
| 2012/0216673 | A1 * | 8/2012 | Chang | F15B 15/1452 92/165 R |

OTHER PUBLICATIONS

Notice of Allowance Dated Apr. 13, 2015 U.S. Appl. No. 13/447,411.
Non Final Office Action Dated Dec. 18, 2014 U.S. Appl. No. 13/447,411.
U.S. Appl. No. 13/447,411, filed Apr. 16, 2012.

* cited by examiner

*Primary Examiner* — Nathaniel Wiehe
*Assistant Examiner* — Daniel Collins
(74) *Attorney, Agent, or Firm* — Eschweiler & Associates, LLC

(57) ABSTRACT

A linear actuator has a housing with a bore extending therethrough. A first portion of the bore extends into the housing from a first end, and a second portion of the bore extends into the housing from a second end of the housing. The second portion of the bore has a rectangular geometry with substantially rounded corners when viewed from the second end. A shaft is in sliding engagement with the first portion of the housing. A piston member is coupled to the shaft and has a rectangular geometry with substantially rounded corners. The piston member is in sliding engagement with a first interior surface of the second portion of the bore via one or more o-rings. An anti-rotation apparatus is associated with one or more of the piston member and the shaft, wherein the anti-rotation member generally prevents a rotation of the shaft with respect to the housing.

30 Claims, 11 Drawing Sheets

COMPACT LINEAR ACTUATOR WITH ANTI-ROTATION DEVICE

REFERENCE TO RELATED APPLICATION

This application is a continuation-in-part of and claims priority to U.S. patent application Ser. No. 13/447,411 which was filed Apr. 16, 2012, entitled COMPACT LINEAR ACTUATOR WITH ANTI-ROTATION DEVICE, the entirety of which is hereby incorporated by reference as if fully set forth herein.

FIELD

The present invention relates generally to linear actuators, and more particularly to a robust and compact linear actuator having a rectangular piston with substantially rounded corners.

BACKGROUND

Industrial linear actuators perform a variety of functions, such as linearly translating a locating pin, or operating a clamp for maintaining a position of a workpiece. A typical linear actuator comprises a housing having a linearly-translating shaft that is operably coupled to a drive means, such as a pneumatic piston and cylinder arrangement, or a geared electric motor. In many applications, precise positioning of the linearly-translating shaft is essential to maintaining specific tolerances in a final assembly of the workpiece.

It is often desirable that the shaft of the linear actuator not rotate with respect to the housing, but rather, extend in a straight line along a single axis without rotation about the axis. Thus, it is desirable that the yaw, pitch, and roll of the shaft with respect to the linear translation be minimized. Accordingly, attempts have been made to accurately position the shaft with respect to the housing, wherein various mechanisms and shaft designs have been used to prevent such yaw, pitch, and roll.

One common example is illustrated in FIG. 1, wherein a conventional linear actuator 10 is provided having a square shaft 15 that extends and retracts with respect to a housing 20 for positioning a workpiece (not shown). The housing 20, is provided with a square bore 25, wherein the square bore, in conjunction with a sacrificial square bearing 30, guides the shaft 15 throughout its extension and retraction. The sacrificial square bearing 30 is typically comprised of a material that is substantially softer than the square shaft 15, thus allowing the square bearing to wear more quickly than the typically more-expensive square shaft.

The implementation of a sacrificial square bearing 30, however, typically requires the sacrificial square bearing to be replaced on a regular basis, thus leading to increased maintenance costs. Further, while the square shaft 15 and square bore 25 may last significantly longer without requiring replacement than the sacrificial square bearing 30, tight dimensional tolerances of the bearing surfaces 35 of square shaft 15, square bore 25, and square bearing 30 are still typically maintained for accurate operation of the linear actuator. Accordingly, dimensions of twelve or more bearing surfaces that are present between the square shaft 15 and the square bore 25 and square bearing 30 are typically held tightly during the manufacture of the linear actuator 10.

If manufacturing tolerances are not tightly held between the square shaft 15, the square bore 25, and the sacrificial square bearing 30, a potential pitch, yaw, and roll of the square shaft 15 with respect to the housing 20 can present itself, due to increased slop between the shaft, the square bore, and the square bearing. Inaccuracies in positioning of the square shaft 15 with respect to the housing 20 further tend to increase as the usage of the linear actuator 10 increases, thus leading to an even greater potential of production losses due to missed tolerances on the workpiece.

Thus, square shafts 15 are typically more costly to manufacture and maintain, and can provide undesirable production losses. Round shafts (not shown) are typically less costly, however, the prevention of rotation of a round shaft is typically accomplished by addition of an anti-rotation pin or other mechanism, wherein the anti-rotation pin or mechanism typically adds length to the linear actuator, especially when the linear actuator is fluid-driven, thus requiring some form of a piston and cylinder arrangement. Thus, conventionally, the anti-rotation mechanism is a separate component coupled to an end of a cylindrical piston and cylinder arrangement, wherein the additional length added by the anti-rotation mechanism can be deleterious in certain applications requiring an abbreviated length linear actuator.

Furthermore, it is often desirable to implement significant actuating forces for extending and retracting the shaft 15 of the linear actuator 10. For example, in some applications, the linear actuator 10 is utilized for clamping a sheet metal component to a fixturing jig, wherein a predetermined pressure on the sheet metal component must be maintained to prevent movement thereof. As such, a positioning member can be coupled to the shaft 15 in order to selectively engage a hole or other feature in the sheet metal component during welding operations. During such welding operations, the sheet metal may expand or otherwise deform, thus side-loading the shaft 15 with a force that may prevent the shaft from retracting.

Accordingly, a need exists in the art for a reliable, low-maintenance linear actuator that provides accurate positioning of the shaft over a substantially longer period of use than previously achieved. Further, a need exists for a linear pneumatic actuator having a compact profile, wherein the actuator is operable to provide comparable force to the shaft to conventional actuators while occupying significantly less space.

SUMMARY

The present invention overcomes the limitations of the prior art by providing a configurable linear actuator that generally prevents a rotation of its shaft while maintaining critical dimensional constraints than conventional linear actuators. The present invention further provides a robust linear actuator operable to provide significant clamping forces while maintaining critical dimensional constraints in a smaller footprint than conventional linear actuators. Consequently, the following presents a simplified summary of the invention in order to provide a basic understanding of some aspects of the invention. This summary is not an extensive overview of the invention. It is intended to neither identify key or critical elements of the invention nor delineate the scope of the invention. Its purpose is to present some concepts of the invention in a simplified form as a prelude to the more detailed description that is presented later.

The present invention is directed generally toward a linear actuator having a housing, wherein the housing has a bore extending therethrough. A first portion of the bore extends a first distance into the housing from a first end of the housing, and a second portion of the bore extends a second distance into the housing from a second end thereof. The first portion of the bore has a first geometry when viewed from the first end, and the second portion of the bore has a second geometry when viewed from the second end. The second geometry is polygonal with substantially rounded corners, wherein a first interior surface of the second portion of the bore comprises a substantially planar first bearing surface. In one example, the second geometry is generally rectangular with substantially rounded corners.

In accordance with the invention, the linear actuator further comprises a shaft having an axis associated therewith, wherein the shaft has a third geometry when viewed along the axis, and wherein the shaft is in sliding engagement with the first portion of the housing. The first geometry of the first portion of the bore and the third geometry of the shaft, for example, mate with one another, therein providing the sliding engagement therebetween. The first and thirds geometries, for example, are generally circular. A piston member is further operatively coupled to the shaft, wherein the piston member has a fourth geometry when viewed along the axis of the shaft. The fourth geometry is polygonal with substantially rounded corners in a manner similar to the second geometry of the second portion of the bore, wherein the piston member is in sliding engagement with the first interior surface of the second portion of the bore. The piston member, for example, has a fourth geometry that is rectangular with substantially rounded corners that is complimentary to the second geometry of the second portion of the bore. In one example, the second portion of the bore has a height that is substantially greater than a width thereof when viewed along the axis, wherein the second and fourth geometries provide a narrow profile for the linear actuator.

The piston member further comprises a groove about a periphery thereof, wherein one or more o-rings is positioned along the axis within the groove. In one example, two o-rings are sequentially positioned along the axis within the groove, and wherein the two o-rings generally abut one another within the groove. The one or more o-rings are in sliding engagement with the second portion of the bore, wherein the one or more o-rings substantially seal a variable volume defined by the piston member and the second portion of the bore. Each of the one or more o-rings, for example, has a generally circular cross-section in a relaxed state. The invention presently appreciates that having the two o-rings abutting one another within the singular groove in the piston enables redundancy in sealing the variable volume, while the rectangular second and fourth geometries provide a substantial surface area associated with the piston member for pneumatically translating the piston member within the second portion of the bore, while further limiting costs associated with manufacture of the linear actuator.

In accordance with one example, the groove in the piston member is generally defined by a groove width running generally parallel to the axis and a groove depth running generally perpendicular to the axis, wherein each of the one or more o-rings has a cross-sectional diameter greater than the groove depth. The groove width, for example, is associated with a sum of the cross-sectional diameters of each of the one or more o-rings. The one or more o-rings can have generally equal or differing cross-sectional diameters, and are comprised of a generally resilient, solid material.

Further, in accordance with another example, an anti-rotation apparatus is provided, wherein the anti-rotation apparatus generally prevents a rotation of the shaft with respect to the housing. In one example, an anti-rotation member fixedly coupled to one or more of the piston member and the shaft. The anti-rotation member has a fifth geometry when viewed along the axis of the shaft, wherein the fifth geometry is generally D-shaped, wherein a substantially planar anti-rotation bearing surface is defined between two substantially rounded corners of the anti-rotation member. In a first embodiment, a sliding engagement between is provided in a first orientation of the anti-rotation member, wherein contact between the anti-rotation member and the housing primarily is limited to being between the first bearing surface and the anti-rotation bearing surface. Accordingly, the engagement between the anti-rotation member and the housing generally prevents a rotation of the shaft with respect to the housing.

In another example, the first geometry of the first portion of the bore and third geometry of the shaft have a generally rectangular cross-section when viewed along the axis, wherein the anti-rotation apparatus is generally defined by the sliding engagement between the shaft and the first portion of the bore. One or more sensors can be further provided and configured to detect a position of the shaft with respect to the housing.

In accordance with second embodiment of the invention, a third portion of the bore extends a third distance into the housing from the second portion of the bore, wherein the third portion of the bore has sixth geometry when viewed from the second end of the housing. The first interior surface of the first portion of the bore further comprises a substantially planar second bearing surface, wherein the second bearing surface is not co-planar with the first bearing surface. Accordingly, the third portion of the bore further comprises a third interior surface having a substantially planar third bearing surface, wherein the third bearing surface is co-planar with a second bearing surface of the first portion of the bore. A step is further defined between the second portion of the bore and third portion of the bore, wherein the step limits a translation of the piston with respect to the housing when the anti-rotation member is in the first orientation, therein defining a first stroke of the piston. The anti-rotation member is further configured to be positioned in a second orientation within the bore, wherein contact between the anti-rotation member and the housing is limited to a sliding engagement between anti-rotation bearing surface and the second and third bearing surfaces, therein defining a second stroke of the piston.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of a few of the various ways in which the principles of the invention may be employed. Other objects, advantages and novel features of the invention will become apparent from the following detailed description of the invention when considered in conjunction with the drawings.

DETAILED DESCRIPTION

Figure 1:
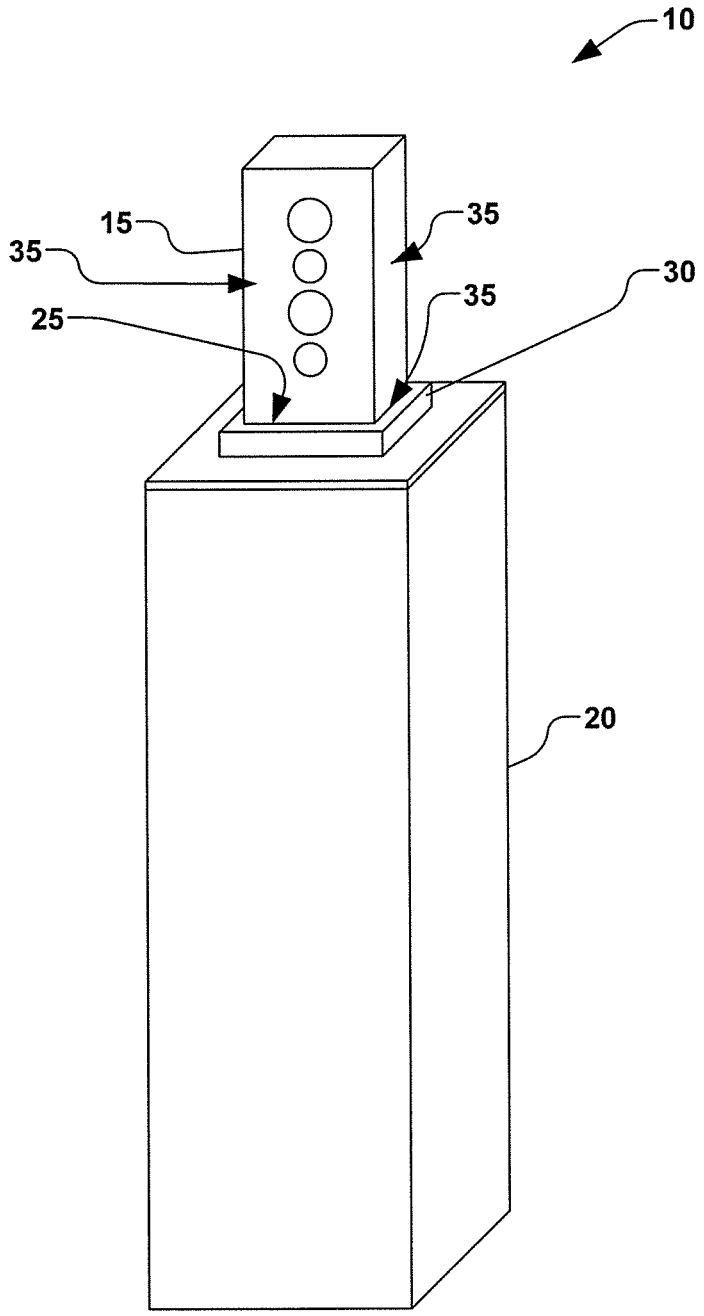
FIG. 1 (Prior Art)
FIG. 1 illustrates a conventional linear actuator having a square anti-rotational shaft.

The present invention will be described with reference to the drawings wherein like reference numerals are used to refer to like elements throughout. It should be understood that the description of these aspects are merely illustrative and that they should not be taken in a limiting sense. In the following description, for purposes of explanation, numerous specific details are set forth in order to provide a thorough understanding of the present invention. It will be evident to one skilled in the art, however, that the present invention may be practiced without these specific details. In other instances, well-known structures and devices are shown in block diagram form in order to facilitate description of the present invention.

Figure 2:
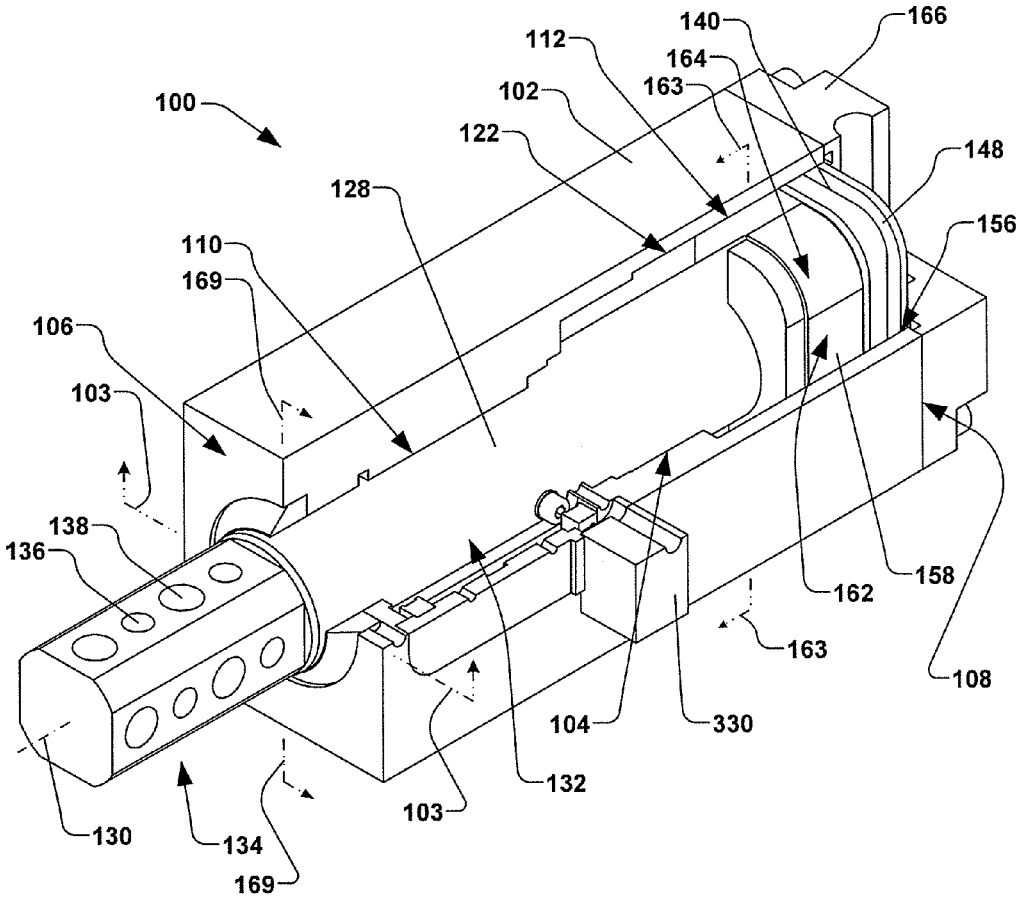
FIG. 2 illustrates a perspective partial cross-sectional view of an exemplary linear actuator according to one aspect of the present invention.
Figure 3:
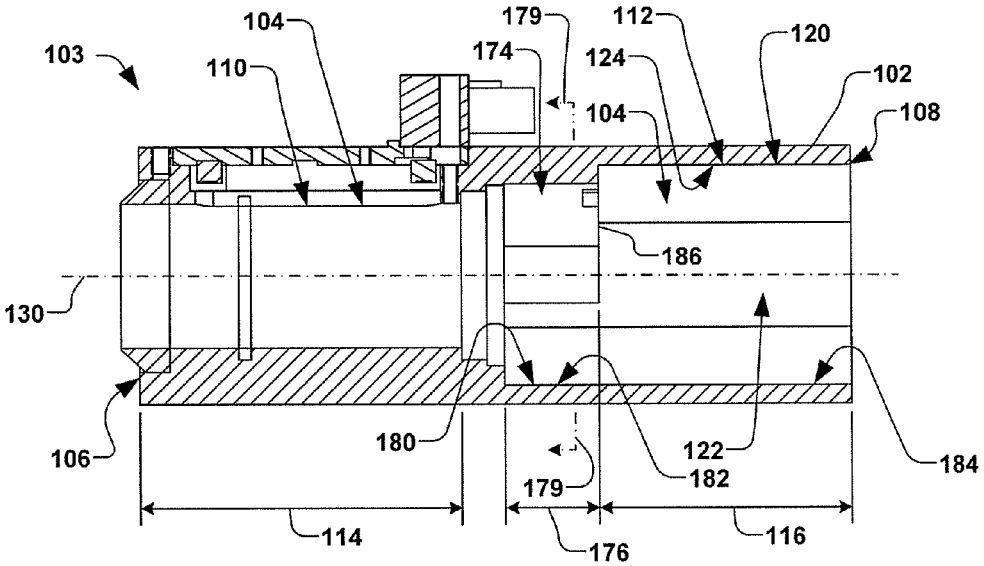
FIG. 3 illustrates a longitudinal cross-section of a housing of the linear actuator of FIG. 2 in accordance with another exemplary aspect of the present invention.

Referring now to the Figures, in accordance with the present invention, FIG. 2 illustrates a perspective partial cross-sectional view of an exemplary linear actuator 100. The linear actuator 100 comprises a housing 102 having a bore 104 extending therethrough, wherein the housing 102 of FIG. 2 is further illustrated in cross-section 103 in FIG. 3. The bore 104, as shown in FIG. 3, for example, extends from a first end 106 of the housing 102 to a second end 108 of the housing, wherein the housing is generally contiguous (e.g., formed from a contiguous block of metal). In the present example, the bore 102 comprises at least a first portion 110 associated with the first end 106 of the housing 102 and a second portion 112 associated with the second end 108 of the housing. The first portion 110 of the bore 104, for example, extends a first distance 114 into the housing 102 from the first end 106 thereof. The second portion 112 of the bore 104 extends a second distance 116 into the housing from the second end 108 of the housing.

Figure 4:
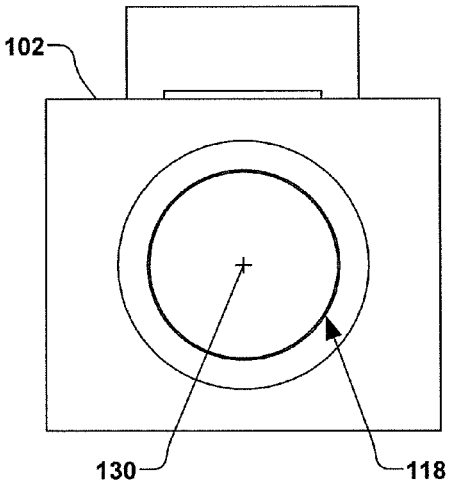
FIG. 4 illustrates a view from a first end of the housing of FIG. 3.

In accordance with one aspect of the invention, the first portion 110 of the bore 104 has a first geometry 118 associated therewith, when viewed from the first end 106 of the housing, as illustrated in FIG. 4. In the present example, the first geometry 118 is generally circular. Alternatively, the first geometry 118 can be another rounded shape, such as an oval or ellipse (not shown). In still another alternative, the first geometry 118 can be polygonal, such as a rectangle, square, or other multiple-sided polygon. Accordingly, the first geometry 118 can be any geometrical shape, and all such geometries are contemplated as falling within the scope of the present invention.

Figure 5:
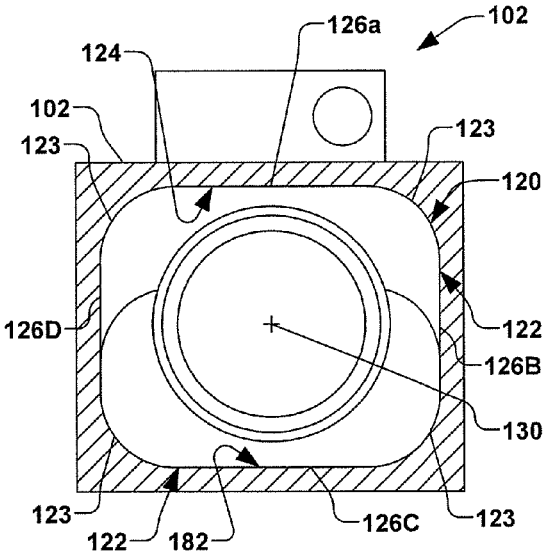
FIG. 5 illustrates a cross-sectional view from a second end of the housing of FIG. 3.

As illustrated in FIG. 5, the second portion 112 of the bore 102 has a second geometry 120 when viewed from the second end 108 of FIGS. 2 and 3, wherein the second geometry generally defines a first interior surface 122 of the second portion of the bore. The second geometry 120, for example, is generally polygonal with substantially rounded corners 123. In accordance with the invention, the first interior surface 122 of the second portion 112 of the bore 104 further comprises a substantially planar first bearing surface 124, wherein the first bearing surface is generally defined by one side 126 of the second geometry. In the present example, side 126A of the generally rectangular second geometry 120 generally defines the first bearing surface 124. It should be noted that the second geometry 120 can comprise any number of sides 126 (e.g., of equal or unequal lengths) with substantially rounded corners 128 between the sides, as will be further discussed infra.

Figure 6:
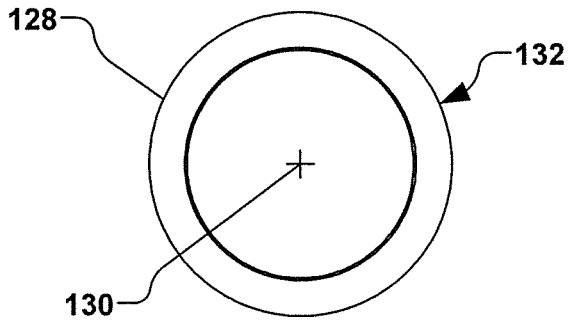
FIG. 6 illustrates a view from an end of a shaft of the linear actuator according to the yet another aspect of the present invention.

Referring again to FIG. 2, the linear actuator 100 of the present invention further comprises a shaft 128, wherein the shaft is in sliding engagement with at least the first portion 110 of the bore 104. The shaft 128 has an axis 130 associated therewith, wherein, in general, the shaft is configured to travel along the axis. The shaft 128 further has a third geometry 132 when viewed from an end 134 thereof along the axis, as illustrated in FIG. 6. The shaft 128 of FIG. 2, for example, is configured to extend and retract through the first end 106 of the housing 102 along the axis 130. In one example, the first geometry 118 of the first portion 110 of the bore 104 and the third geometry 132 of the shaft 128 are generally round when viewed from the first end 108 of the housing 102. For example, the shaft 128 and the first portion 110 of the bore 104 are generally circular in cross-section (ie., the first geometry 118 of the bore and the third geometry 132 of the shaft are generally circular). It should be noted, however, that the first and third geometries 118 and 132 can comprise any round geometry, such as an ovular geometry or other rounded geometry, and all such geometries are contemplated as falling within the scope of the present invention. In another example, the shaft 128 and first portion 110 of the bore 104 are generally polygonal in cross-section when viewed from the first end 106 of the housing 102 (e.g., along the axis 130). For example, the first and third geometries 118 and 132 can be generally rectangular or square in cross-section, however, any polygonal geometry having any number of equal or unequal sides is also contemplated as falling within the scope of the present invention, wherein the shaft 128 slidingly engages the first portion 110 of the bore 104.

As further illustrated in FIG. 2, the end 134 of the shaft 128, for example, is adapted to connect to one or more end effectors (not shown), such as a clamping arm or positioning pin, as will be understood by one of ordinary skill in the art. For example, the end 134 may comprise one or more holes 136 (e.g., threaded or thru-holes), machined flats 138 or other features that generally permit the coupling of the one or more end effectors thereto.

According to another exemplary aspect of the invention, the linear actuator 100 further comprises a piston member 140 operatively coupled to the shaft 128. The piston member 140, in one example, is fixedly coupled to the shaft 128, wherein the piston member and shaft are generally prevented from rotating with respect to one another. Alternatively, the piston member 140 can be rotatably coupled to the shaft 128, wherein the piston member and shaft around operable to rotate with respect to one another about the axis 130.

Figure 7:
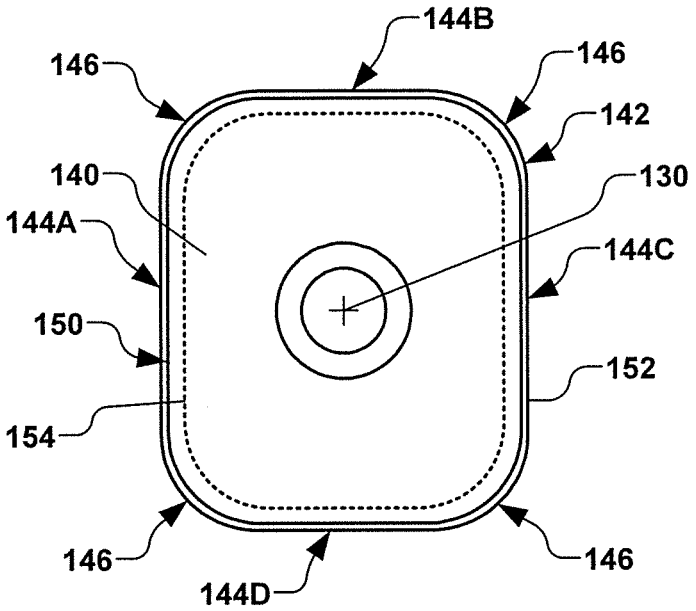
FIG. 7 illustrates view of an exemplary piston member according to another exemplary aspect of the invention.

As illustrated in FIG. 7, the exemplary piston member 140 has a fourth geometry 142 when viewed along the axis 130 of the shaft, wherein the fourth geometry, for example, is polygonal with substantially rounded corners. The piston member 140 is thus configured to be in mating sliding engagement with the first interior surface 122 of the second portion 112 of the bore 104 of FIG. 3. In one example, the fourth geometry 142 is rectangular having four edges 144 with substantially rounded corners 146 therebetween. In another example, the fourth geometry 142 is square with similarly substantially rounded corners. The fourth geometry 142 of the piston member 140 is thus configured to slidingly mate with the first interior surface 122 of the second portion 112 of the bore 104. It should be noted that the respective second and fourth geometries 120 and 142 may have any number of equal or unequal sides 126 and edges 144 with rounded corners 146 therebetween, so long as the second and fourth cross sections share a similar geometry such that the piston member 140 slidingly engages the first interior surface 122. For example, the second and fourth geometries 120 and 142 may each comprise three-sides, five-sides, six-sides, etc., all with substantially rounded corners therebetween.

The piston member 140, as illustrated in FIG. 7, for example, further comprises a sealing member 148 operatively coupled to a periphery 150 of the piston member. For example, the sealing member 148 comprises a generally resilient o-ring 152 positioned in an o-ring groove 154 about the periphery 150 of the piston member. Thus, as illustrated in FIG. 2, an interface 156 between the sealing member 148 and the first interior surface 122 of the bore 104 thus generally defines a sliding seal between the piston member 140 and the housing 102. The sealing member 148, for example, is configured to wrap around the generally rounded corners of the periphery 150 of the piston member, thus providing an adequate sealing interface between the piston member and the housing 102. Thus, the substantially rounded corners 146 of the piston member 140 generally permit the sealing member 148 to adequately seal the interface 156, whereas a sharp corner (not shown) would typically not provide such an adequate seal.

Figure 8:
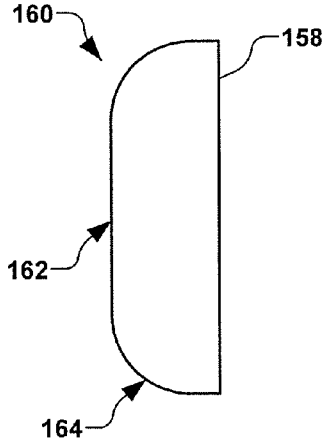
FIG. 8 illustrates a cross-sectional view of an exemplary anti-rotation member in accordance with still another aspect of the present invention.
Figure 9:
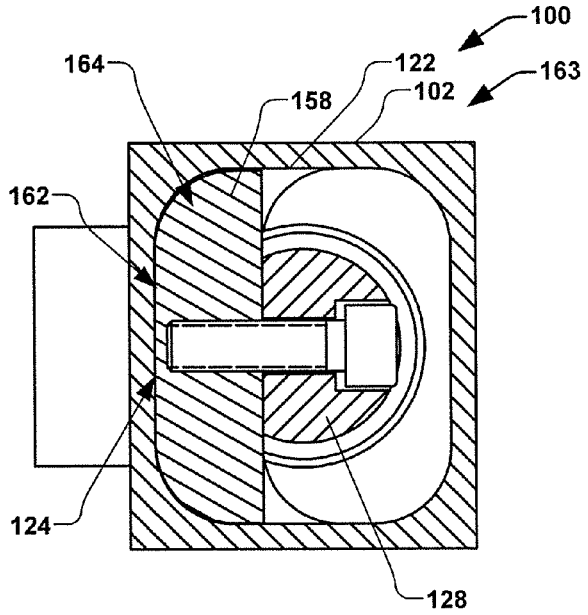
FIG. 9 illustrates a cross-sectional view of the linear actuator from a second end in accordance with a further aspect of the present invention.
Figure 10:
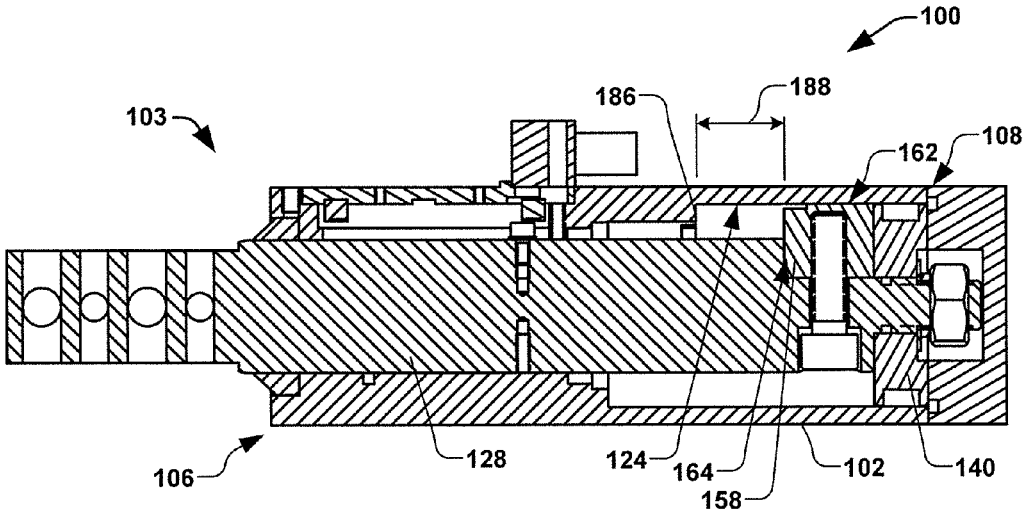
FIG. 10 illustrates a cross-sectional view of the linear actuator of FIG. 2 with the anti-rotation member in a first orientation in accordance with another aspect of the invention.

In accordance with the invention, the linear actuator 100 of FIG. 2 further comprises an anti-rotation member 158 fixedly coupled to one or more of the piston member 140 and the shaft 128. The anti-rotation member 158, when viewed along the axis 130 of the shaft 128, further has a fifth geometry 160 associated therewith, as illustrated in FIG. 8. The fifth geometry 160 is generally D-shaped, wherein a substantially planar anti-rotation bearing surface 162 is defined between two substantially rounded corners 164 of the anti-rotation member 158. Accordingly, when viewed from cross-section 163 of the linear actuator 100 of FIG. 2, as illustrated in FIG. 9, contact between the anti-rotation member 158 and the housing 102 primarily exists along a sliding engagement between the first bearing surface 124 and the anti-rotation bearing surface 162 in a first orientation 164 of the anti-rotation member with respect to the housing. FIG. 10 further illustrates the cross-section 103 of the linear actuator 100 of FIG. 2, wherein the anti-rotation member 158 is in the first orientation 164, and wherein sliding contact between the anti-rotation member and the housing 102 primarily exists between the first bearing surface 124 of the housing and the anti-rotation bearing surface 162 of the anti-rotation member.

Accordingly, the shaft 128 is generally prevented from a rotation about the axis 130 of FIG. 2 with respect to the housing 102. The anti-rotation member 158, for example, is machined such that the two substantially rounded corners 164 of FIG. 8 do not generally contact the first interior surface 122 of the housing of FIGS. 2 and 9, wherein most, if not all, of the contact between the anti-rotation member 158 and the housing occurs at the interface between the anti-rotation bearing surface 162 and the first bearing surface 124 (when the anti-rotation member is in the first orientation 164 with respect to the housing 102). Thus, higher degrees of dimensional precision during manufacture primarily exist along the first bearing surface 124 of the housing and the anti-rotation bearing surface 162 of the anti-rotation member 158, while machining accuracies of the remainder of the first interior surface 122 and anti-rotation member 158 may be relaxed. Accordingly, a significant cost savings can be realized in the machining of the linear actuator 100 of the present invention.

Another clear advantage of the present invention is that the first bearing surface 124, such as that illustrated in FIG. 10, also functions as a portion of the interface 156 between the piston member 140 and the housing 104. By providing the first bearing surface 124 as a part of the first interior surface 122 (along which the piston member 140 translates), the anti-rotation member 158 shares the space needed for the translation of the piston member 140 within the housing 104. Thus, the overall length of the linear actuator 100 can be minimized in a way that has not been seen heretofore.

Figure 11:
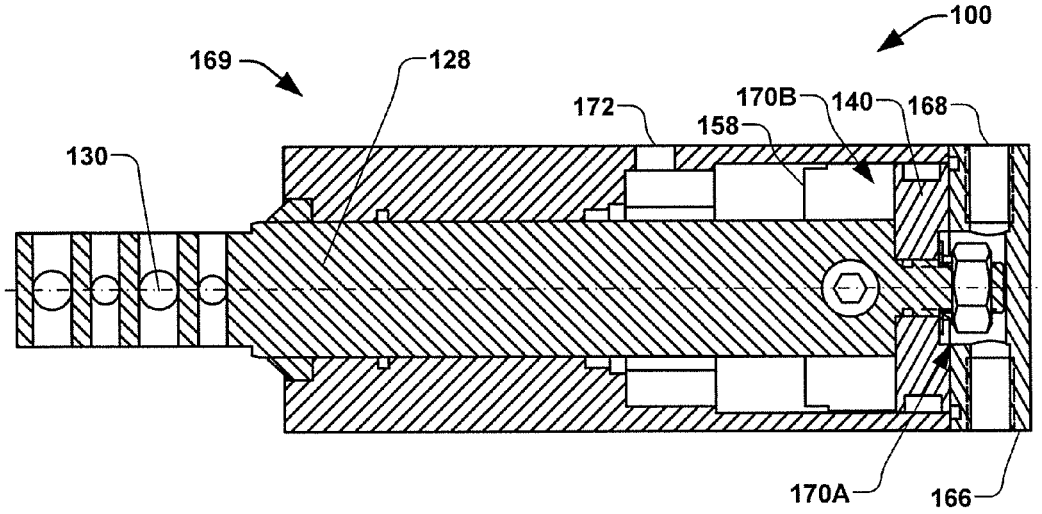
FIG. 11 illustrates another cross-sectional view of the linear actuator of FIG. 2 according to another exemplary aspect of the invention.

As illustrated in FIG. 2, the linear actuator 100 further comprises an end cap 166 operatively coupled to the housing 102, wherein the end cap generally encloses second portion 112 of the bore 104. The end cap 166 of the linear actuator 100 may be further configured with one or more first ports 168, as illustrated in cross-section 169 shown in FIG. 11, wherein the one or more ports provide selective fluid communication between a pressurized fluid source (not shown) and a first side 170A of the piston member 140. Accordingly, the housing 102 further comprises one or more second ports 172 in fluid communication with a second side 170B of the piston member 140. Thus, the pressurized fluid source can selectively translate the piston member 140, anti-rotation member 158, and shaft 128 along the axis 130, based on which of the first and second ports 168 and 172 are presented with pressurized fluid (e.g., a liquid or gas).

Figure 12:
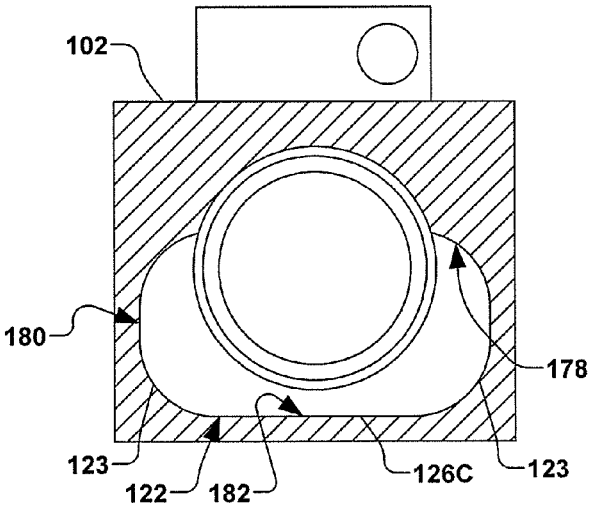
FIG. 12 illustrates another cross-sectional view of the housing of FIG. 2 in accordance with another aspect of the invention.

In accordance with another embodiment of the invention, referring again to FIG. 3, the bore 104 further comprises a third portion 174, wherein the third portion of the bore extends a third distance 176 into the housing 102 from the second portion 112 of the bore. The third portion 174 of the bore 104 has sixth geometry 178 when viewed from the second end 108 of the housing 102, as illustrated in cross-section 179 in FIG. 12. The third portion 174 of the bore 104 further defines a second interior surface 180 of the bore, wherein the second interior surface comprises a substantially planar second bearing surface 182. The second bearing surface 182 is further co-planar with a third bearing surface 184 of the first interior surface 122. Furthermore, the third portion 174 of the bore 104 of FIG. 3 further defines a step 186 between the second portion 112 and the third portion of the bore, wherein the step generally limits a translation of the piston member 140 with respect to the housing 102 when the anti-rotation member 158 is in the first orientation 164 of FIGS. 2, 9 and 10. Accordingly, as illustrated in FIG. 10, when the anti-rotation member 158 is in the first orientation 164, a first stroke 188 (associated with the first distance 116 of FIG. 3) of the piston member 140 and shaft 128 is generally defined. For example, the anti-rotation member 158 utilizes the step 186 to limit the first stroke 188 when the piston member 140 travels from the second end 108 toward the first end 106 of the housing 102.

Figure 13:
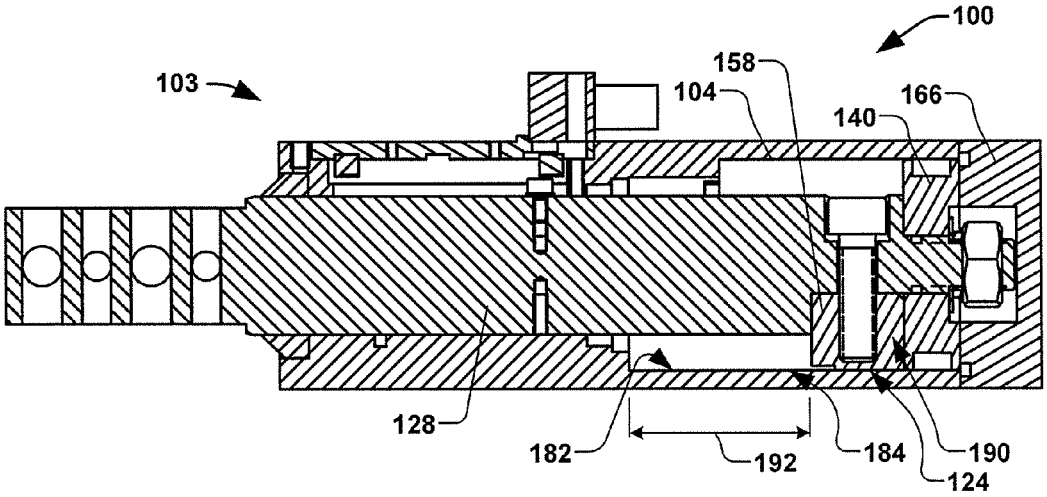
FIG. 13 illustrates a cross-sectional view of the linear actuator of FIG. 2 with the anti-rotation member in second first orientation in accordance with still another aspect of the invention.
Figure 14:
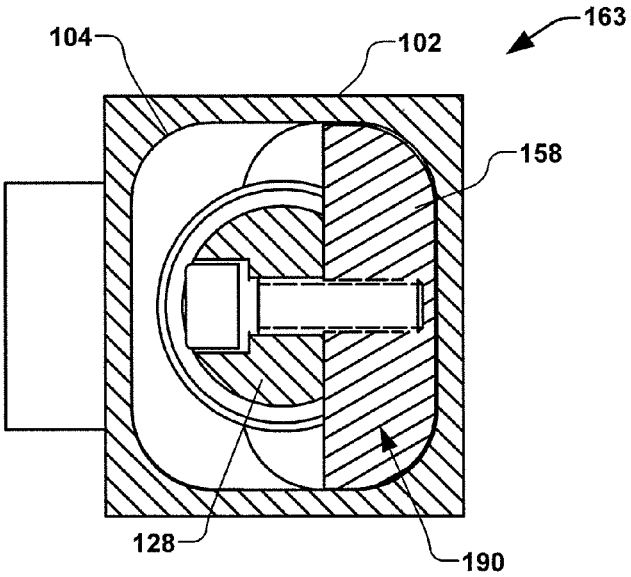
FIG. 14 illustrates another cross-sectional view of the linear actuator from the second end when the anti-rotation member is in the second orientation in accordance with still a further aspect of the present invention.

In another exemplary aspect of the invention, the anti-rotation member 158 is further configured to be positioned in a second orientation 190 with respect to the housing 102 within the bore 104 of FIG. 2, as illustrated in FIGS. 13-14. FIG. 13, for example, represents cross-section 103 of the linear actuator 100 of FIG. 2 when the anti-rotation member 158 is positioned in the second orientation 190, while FIG. 14 views the linear actuator from cross section 163 of FIG. 2 when the anti-rotation member is positioned in the second orientation. Accordingly, contact between the anti-rotation member 158 and the housing 102 is primarily present along a sliding engagement between the second bearing surface 182 and third bearing surface 184 and the anti-rotation bearing surface 162 when the anti-rotation member is in the second orientation 190 with respect to the housing. Thus, a second stroke 192 of the piston member 140 is generally defined, as illustrated in FIG. 13, wherein the second stroke, in the present example, is longer than the first stroke 188 of FIG. 10.

The present invention further contemplates that additional strokes (not shown) can be achieved in a similar manner by utilizing another side (e.g., side 126D and/or side 126B of FIG. 5) as an additional housing bearing surface, wherein the respective side extends further into the housing 102 from the third portion 174 of the bore 104. Further, in such an instance, the second geometry 120 and fourth geometry 142, for example, may alternatively be generally triangular with substantially rounded corners; however, the present disclosure contemplates various other configurations and geometries, as well.

In accordance with still another exemplary aspect of the invention, one or more of the first bearing surface 124, second bearing surface 182, third bearing surface 184, and anti-rotation bearing surface 162 are comprised of a hardened material, wherein minimal wear to the respective surfaces can be achieved. For example, the first bearing surface 124, second bearing surface 182, third bearing surface 184, and anti-rotation bearing surface 162 are comprised of one or more materials having a hardness of approximately HRC 65 or greater, wherein the sliding engagement between the anti-rotation member 158 and the housing 102 can be defined as a hard-on-hard bearing surface. Such a hard-on-hard bearing surface generally provides minimal wear to both the shaft 128 and housing 102, wherein the minimal wear can be achieved with a small amount of lubrication.

Figure 15A:
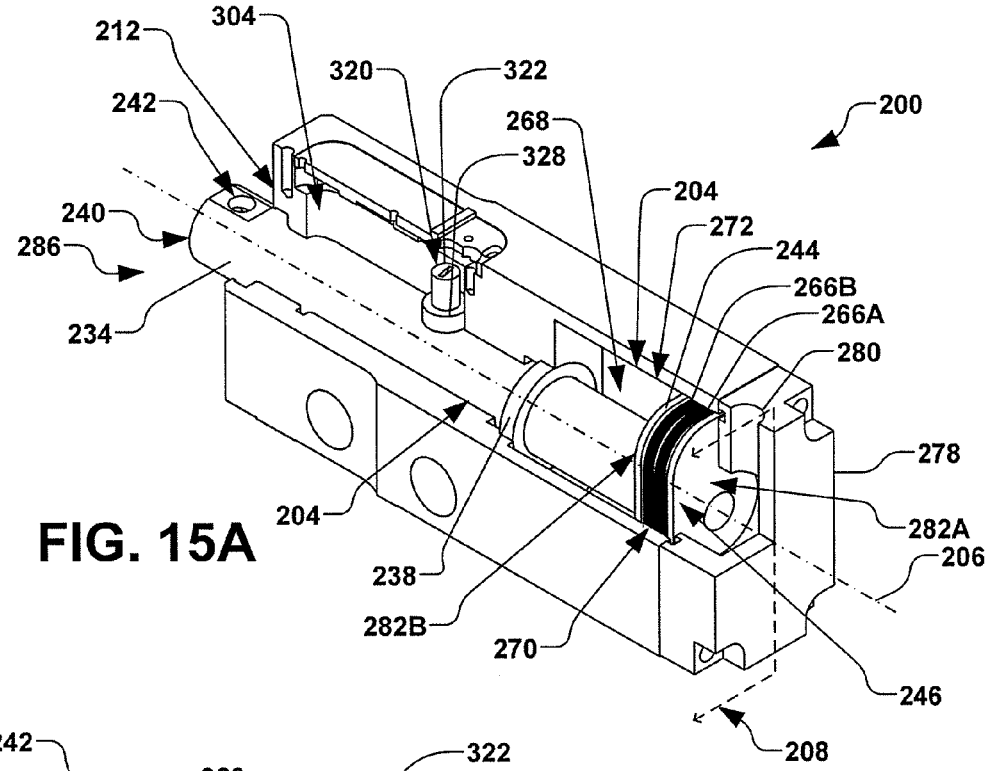
FIG. 15A illustrates a perspective partial cross-sectional view of an exemplary linear actuator in a retracted position according to one aspect.
Figure 15B:
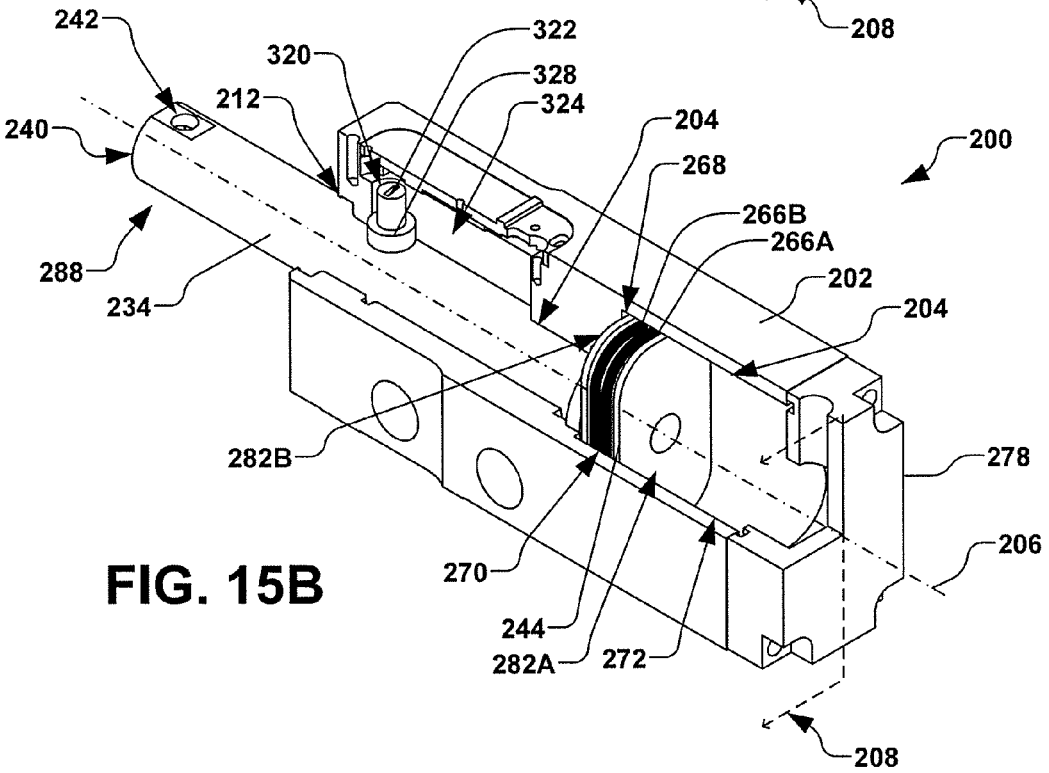
FIG. 15B illustrates a perspective partial cross-sectional view of the exemplary linear actuator of FIG. 2A in an extended position according to another aspect.
Figure 16:
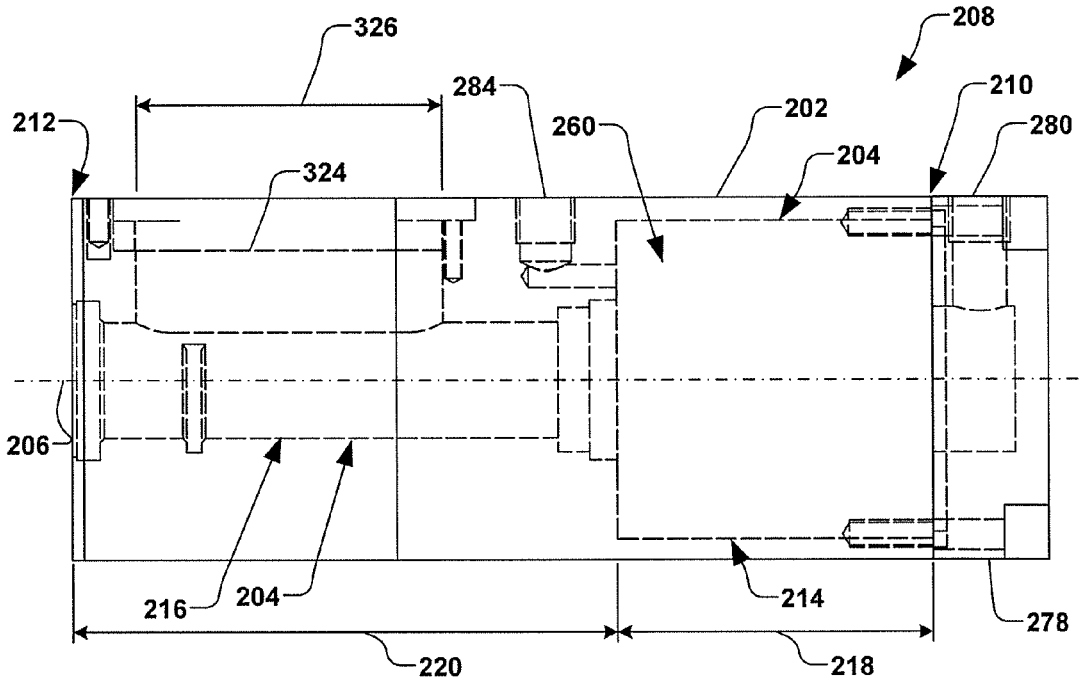
FIG. 16 illustrates a longitudinal cross-section of a housing of the linear actuator of FIGS. 15A and 15B in accordance with another exemplary aspect.

Referring now to FIGS. 15A and 15B, a perspective partial cross-sectional view of another exemplary linear actuator 200 is illustrated in accordance with other aspects of the present disclosure. The linear actuator 200 comprises a housing 202 having a bore 204 extending therethrough, therein defining an axis 206. The housing 202 of FIGS. 15A and 15B is further illustrated in cross-section 208 in FIG. 16. The bore 204, as shown in FIG. 16, for example, extends from a first end 210 of the housing 202 to a second end 212 of the housing, wherein the housing in the present example is generally contiguous. In the present example, the bore 202 comprises at least a first portion 214 associated with the first end 210 of the housing 202 and a second portion 216 associated with the second end 212 of the housing. The first portion 214 of the bore 204, for example, extends a first distance 218 into the housing 202 from the first end 106 thereof. The second portion 212 of the bore 204, for example, extends a second distance 220 into the housing from the second end 208 of the housing.

Figure 17:
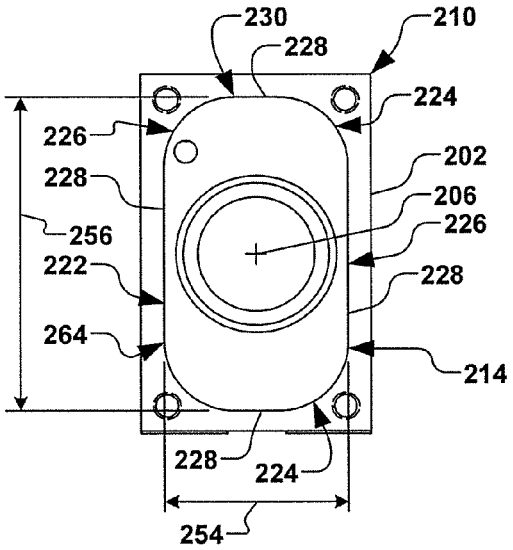
FIG. 17 illustrates a view from a first end of the housing of FIG. 16.

In accordance with one aspect of the disclosure, the first portion 214 of the bore 204 has a first geometry 222 associated therewith, when viewed from the first end 210 of the housing 202, as illustrated in FIG. 17. In the present example, the first geometry 222 is generally polygonal with substantially rounded corners 224, therein defining a piston bearing surface 226 of the first portion 214 of the bore 204. It should be noted that the first geometry 222 can comprise any number of sides 228 (e.g., of equal or unequal lengths) with substantially rounded corners 124 between the sides. In a preferred embodiment, the first geometry 222 of the first portion 214 of the bore 204 comprises four sides 228, therein defining a generally rectangular geometry 230 with substantially rounded corners 124.

Figure 18:
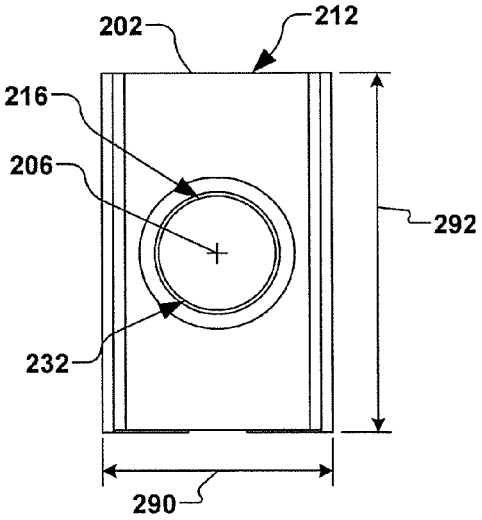
FIG. 18 illustrates a view from a second end of the housing of FIG. 16.

In the present example, the second portion 216 of the bore 204 of FIG. 15A, 15B has a second geometry 232 associated therewith, when viewed from the second end 212 of the housing 202, as illustrated in FIG. 18. The second geometry 232, for example, is generally circular. Alternatively, the second geometry 232 can be another rounded shape, such as an oval or ellipse (not shown). In still another alternative, the second geometry 232 can be polygonal, such as a rectangle, square, or other multiple-sided polygon. Accordingly, the second geometry 232 can comprise any geometric shape, and all such geometries are contemplated as falling within the scope of the present invention.

Figure 19:
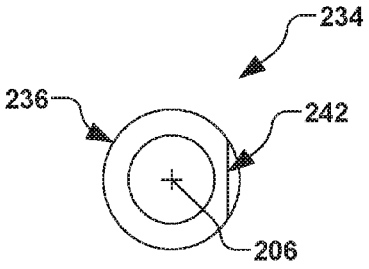
FIG. 19 illustrates a view from an end of a shaft of the linear actuator according to the yet another aspect.

Referring again to FIGS. 15A, 15B, the linear actuator 200 of the present disclosure further comprises a shaft 234, wherein the shaft is in sliding engagement with at least the second portion 216 of the bore 204. The shaft 234, for example, is configured to travel along the axis 206, and when viewed from the second end 212 of the housing 202, has a third geometry 236 associated therewith, as illustrated in FIG. 19. In one example, the third geometry 236 of the shaft 234 is generally complimentary to the second geometry 232 of the second portion 216 of the bore 204 of FIG. 18. For example, the shaft 234 and the second portion 216 of the bore 204 are generally circular in cross-section (ie., the second geometry 232 of the bore and the third geometry 236 of the shaft are generally circular). It should be noted, however, that the second geometry 232 and third geometry 236 can comprise any round geometry, such as an ovular geometry or other rounded geometry, and all such geometries are contemplated as falling within the scope of the present invention. Alternatively, the shaft 234 and second portion 216 of the bore 204 are generally polygonal in cross-section, such as being generally rectangular or square in cross-section. Any round or polygonal geometry having any number of equal or unequal sides is therefore contemplated as falling within the scope of the present disclosure, wherein the shaft 234 slidingly engages the second portion 216 of the bore 204 in a complimentary relationship. Further, one or more shaft bearing or sealing members 238 may be provided to further guide the shaft 234 along the axis 206 within the bore 204 and/or provide a sliding seal between the shaft 234 and the housing 202.

In accordance with another example, an end 240 of the shaft 234 of FIGS. 15A, 15B is adapted to connect one or more end effectors (not shown) thereto, such as a positioning pin, clamping arm, or other device or member applicable to the use of the linear actuator 200. For example, the end 240 of the shaft 234 may comprise one or more features 242 such as mounting holes (e.g., threaded or thru-holes), machined flats, or other features facilitating a coupling of the aforementioned one or more end effectors thereto.

In accordance with the present disclosure, the linear actuator 200 of FIGS. 2A-2B further comprises a piston 244 operatively coupled to the shaft 234. The piston 244, for example, is fixedly coupled to the shaft 234, wherein the piston and shaft are generally prevented from rotating with respect to one another. Alternatively, the piston 244 can be rotatably coupled to the shaft 234, wherein the piston and shaft are operable to rotate with respect to one another about the axis 206, but are generally fixed along the axis relative to one another.

Figure 20:
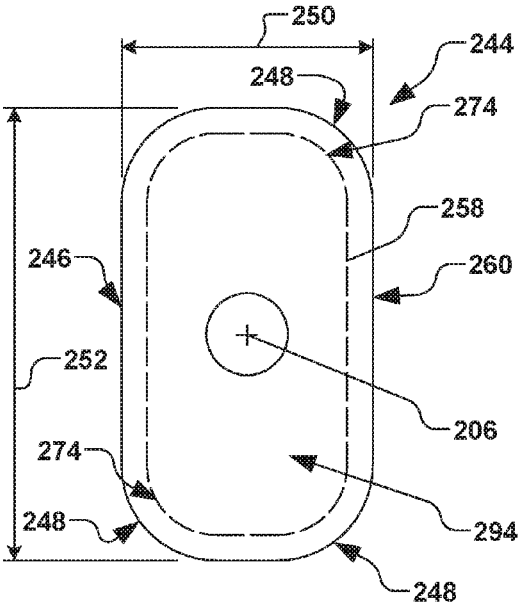
FIG. 20 illustrates view of an exemplary piston according to another exemplary aspect.
Figure 21:
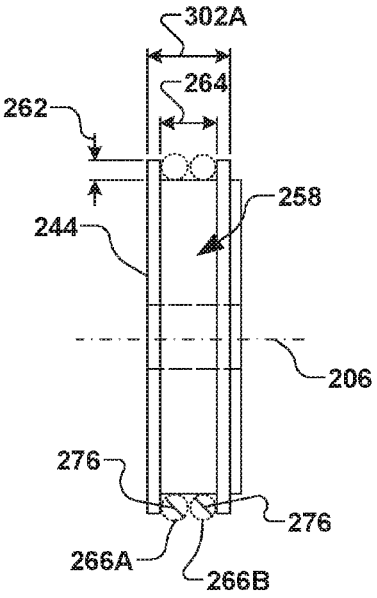
FIG. 21 illustrates a longitudinal view of an exemplary piston according to another exemplary aspect.

In the example illustrated in FIG. 20, the piston 244 has a fourth geometry 246 when viewed along the axis 206, wherein the fourth geometry is generally complimentary to the first geometry 222 of the first portion 214 of the bore 204. For example, the fourth geometry 246 is generally polygonal with substantially rounded corners 248. In the preferred embodiment, however, the fourth geometry 246 is generally rectangular with substantially rounded corners 248. A piston width 250 and a piston height 252 associated with the piston 244 illustrated in FIG. 20 and a bore width 254 and a bore height 256 of the first portion of 114 the bore 104 illustrated in FIG. 17 are sized such that a clearance (not shown) exists between the piston and the first portion of the bore. The piston 244 further comprises a groove 258 about a periphery 260 of the piston, wherein the groove is generally defined by a groove depth 262 running generally perpendicular to the axis 206 and a groove width 264 running generally parallel to the axis, as illustrated in FIG. 21.

Figure 22:
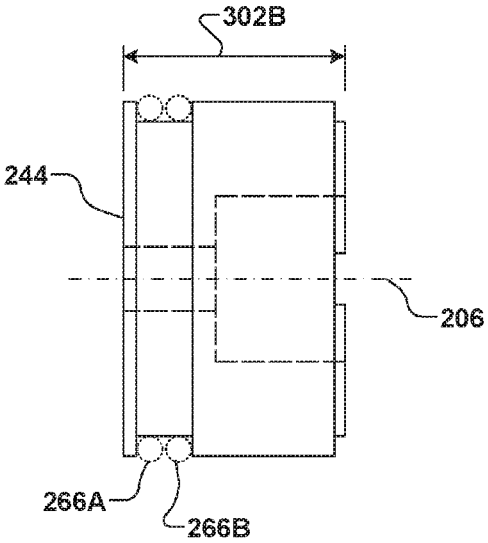
FIG. 22 illustrates a longitudinal view of another exemplary piston providing a limited stroke according to another exemplary aspect.

In accordance with the disclosure, at least two o-rings 266 (shown in phantom as o-rings 266A, 266B in FIGS. 21 and 22) are sequentially positioned along the axis 206 within the groove 258 of the piston 244, wherein the at least two o-rings generally abut one another within the groove. The at least two o-rings 266A, 266B are in further sliding engagement with the first portion 214 of the bore 204, wherein the at least two o-rings substantially seal a variable volume 268 generally defined by the piston 244 and the first portion of the bore, as illustrated in FIGS. 15A, 15B and FIG. 16. As such, an interface 270 between the at least two o-rings 266A, 266B and a surface 272 of the first portion 214 of the bore 204 thus generally defines a sliding seal between the piston 244 and the housing 202. It should be noted that the groove 258, as illustrated in FIG. 20, for example, has substantially rounded corners 274 that are complimentary to the substantially rounded corners 248 of the piston 244, therein generally permitting the at least two o-rings 266A, 266B of FIGS. 15A, 15B to adequately seal the interface 262, whereas a sharp corner (not shown) would typically not provide such an adequate seal.

Each of the at least two o-rings 266A, 266B of FIG. 20, for example, has a cross-sectional diameter 276 greater than the groove depth 262 in order to provide the seal at the interface 270 of FIGS. 15A, 15B upon compression of the at least two o-rings between the piston 244 and the first portion 214 of the bore 204. Further, the groove width 264 is associated with a sum of the cross-sectional diameters 276 of each of the at least two o-rings 266A, 266B. The groove width 264, for example, is slightly greater than or equal to the sum of the cross-sectional diameters 268 of each of the at least two o-rings 266A, 266B to allow for the aforementioned compression.

Each of the at least two o-rings 266A, 266B, for example, are generally compressible and have a generally circular cross-section while in a relaxed state, and may be comprised of a generally resilient, solid material, such as any commercially available o-ring material. The at least two o-rings 266A, 266B for example, can be comprised of one or more of nitrile (e.g., Buna-N) when the linear actuator 200 is utilized in standard environments, fluoroelastomers such as Viton® when the linear actuator is utilized in high heat environments, and/or polyurethanes when the linear actuator is exposed to various other adverse or severe conditions. One distinct advantage of providing the at least two o-rings 266A, 266B, as opposed to providing another type of seal is that o-rings are generally inexpensive and readily attainable in a manufacturing environment.

When compressed between the piston 244 and the first portion 214 of the bore 104, the at least two o-rings 266A, 266B elongate into a generally ovular shape in cross-section, therein providing the seal at the interface 262. The groove width 264, for example, is greater than or equal to the sum of the cross-sectional diameters 276 of each of the at least two o-rings 266A, 266B. The cross-sectional diameters 276 of each of the at least two o-rings 266A, 266B can be generally equal, or one of the at least two o-rings can have a cross-sectional diameter that is greater than the cross-sectional diameter of the remaining of the at least two o-rings. For example, o-ring 266A can be comprised of a softer, more resilient material than the other o-ring 266B, while also having a larger cross-sectional diameter 276 than o-ring 268B. As such, o-ring 266A can provide adequate sealing of the variable volume 268, while the other o-ring 266B provides a substantial support for o-ring 266A, while also providing some sealing capacity. By providing at least two o-rings 266A, 266B in the singular groove 258 of FIGS. 21 and 22, further provides redundancy of sealing the variable volume 268 of FIGS. 15A, 15B. Such a redundancy in sealing is advantageous, especially in lower-pressure pneumatic operation (e.g., less than 120 psi) of the linear actuator 200, wherein greater longevity of the linear actuator is provided over conventional linear actuators.

As illustrated in FIGS. 15A, 15B, the linear actuator 200 further comprises an end cap 278 operatively coupled to the housing 202, wherein the end cap generally encloses the first portion 214 of the bore 204. The end cap 278 of the linear actuator 200 may be further configured with one or more first ports 280 as further illustrated in cross-section 208 of FIG. 16, wherein the one or more first ports provide selective fluid communication between a pressurized fluid source (not shown) and a first side 282A of the piston 244 of FIGS. 15A, 15B. Accordingly, the housing 202 further comprises one or more second ports 284 in FIG. 16 that are in fluid communication with a second side 282B of the piston 244 of FIGS. 15A, 15B. Thus, the pressurized fluid source (e.g., a compressed air or gas source) can selectively translate the piston 244 and shaft 234 along the axis 206, based on which of the first and second ports 280 and 284 are presented with pressurized fluid. Accordingly, the shaft 234, for example, is configured to extend and retract through the second end 212 of the housing 202 along the axis 206, therein defining a retracted position 286 illustrated in FIG. 15A and an extended position 288 illustrated in FIG. 15B.

The linear actuator 200 of the present disclosure thus advantageously provides a significant increase in force capability over prior art actuators by providing the piston 244 having the rectangular fourth geometry 246. For example, as illustrated in FIG. 18, an overall width 290 and height 292 of the linear actuator can be kept compact, while maintaining a large surface area 294 associated with the piston 244 of FIG. 20 in order to provide a large amount of force on the first and second sides 282A, 282B of the piston. Furthermore, the at least two o-rings 266A, 266B positioned in the singular groove 258 of FIGS. 21 and 22, for example, provide a sufficient sealing of the variable volume 268 while also providing redundancy in the case of failure of one o-ring. Conventionally, only one o-ring is provided in an o-ring groove. However, since the fourth geometry 246 of the piston 244 of the present disclosure is rectangular with substantially rounded corners 274, as illustrated in FIG. 20, the inventors presently appreciate a stability increase of the least two o-rings 166A, 166B within the singular groove 258 that is believed to be due, at least in part, to the rounded corners.

Figure 23:
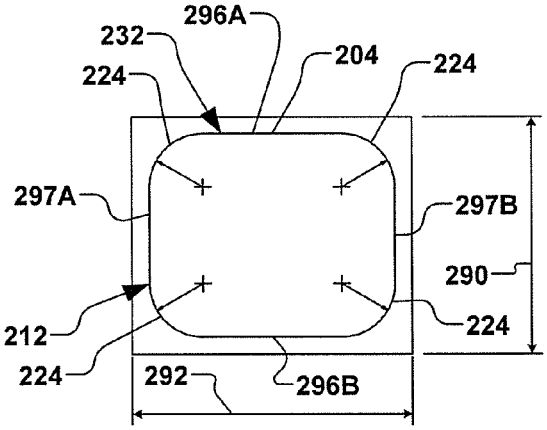
FIG. 23 illustrates a cross-sectional view of an exemplary bore having a rectangular geometry with substantially rounded corners.
Figure 24:
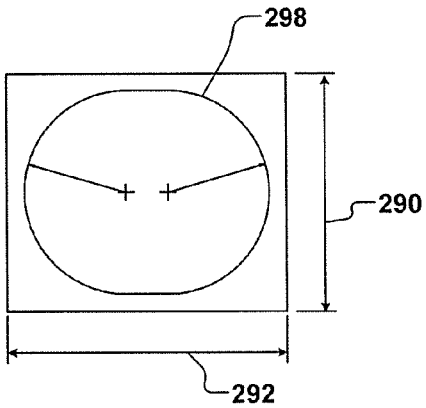
FIG. 24 illustrates a cross-sectional view of a bore having an ovular geometry.

FIG. 23 illustrates another exemplary aspect of the disclosure, wherein the piston bore 204 having the rectangular second geometry 232 (and piston 244 of FIG. 20 having the rectangular fourth geometry 246) is particularly advantageous. As illustrated in FIG. 23, for example, the second geometry 232 of the second portion 212 of the bore 204 is rectangular with substantially rounded corners 224, having parallel opposing sides 296A, 296B and parallel opposing sides 297A, 297B. Providing the parallel opposing sides 296A, 296B and 297A, 297B, the overall width 290 of the linear actuator can be kept compact, while providing maximum actuation forces described above by maximizing the surface area 294 associated with the piston 244 of FIG. 20. For comparison purposes, an ovular bore 298 is illustrated in FIG. 24, wherein the overall height 292 is kept constant between FIGS. 23 and 24. The inventors presently appreciate that the ovular bore 298 of FIG. 24 has a distinct disadvantage over the present rectangular second geometry 232 of FIG. 23 by having a decreased surface area of associated piston. For comparison, as illustrated in FIG. 25, an ovular piston 299 that is sized to fit within the ovular bore 298 of FIG. 24 is positioned within the piston bore 204 having the rectangular second geometry 232.

Figure 25:
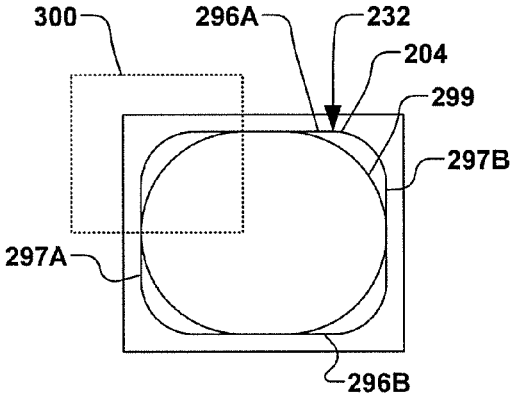
FIG. 25 illustrates a cross-sectional view of an exemplary bore having a rectangular geometry with substantially rounded corners having an ovular piston positioned therein.
Figure 26:
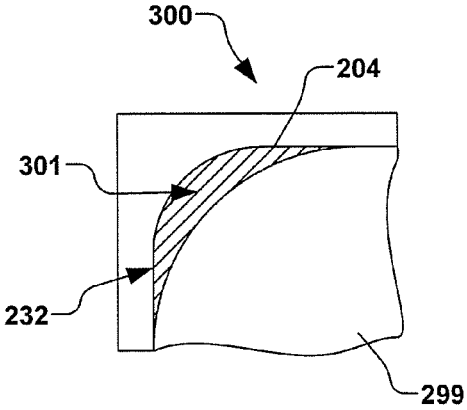
FIG. 26 illustrates a blown-up view of the exemplary bore of FIG. 25, wherein the rectangular geometry of bore provides an advantageous increase in area.

The ovular piston 299 is further illustrated in blown-up view 300 of FIG. 25, wherein the present invention clearly provides an advantageous portion 301 of the bore 204 for additional surface area 294 associated the generally rectangular piston 244 with substantially rounded corners 248 of FIG. 20. As such, by providing the two pairs of opposing sides 296A, 296B and 297A, 297B of FIG. 23, a significant amount of surface area can be attained for the piston, with a no increase in overall width 290 of the housing 204 compared to the ovular bore 298 of FIG. 24. Further, providing the significantly rounded corners 224 of FIG. 23 mitigates wear on the o-rings 266 of FIGS. 15A and 15B.

Referring again to FIGS. 21 and 22, according to yet another exemplary aspect of the disclosure, a length 302A, 302B of the piston 244 along the axis 206 is variable, therein providing a variable stroke (e.g., a difference between the retracted position 286 of the shaft 234 of FIG. 15A and extended position 288 of FIG. 15B). For example, the length 302A of the piston 244 of FIG. 21 provides a longer stroke than the length 299B of the piston shown in FIG. 22.

In accordance with the invention, the linear actuator 200 of FIGS. 15A, 15B further comprises an anti-rotation member 320 fixedly coupled to one or more of the piston 244 and the shaft 234. Accordingly, the shaft 234 is generally prevented from a rotation about the axis 206 with respect to the housing 202. The anti-rotation member 320, for example, comprises a pin 322 operatively coupled to the shaft 234 and a slot 324 defined in the second portion 216 of the bore 204, wherein the slot is generally parallel to the axis 206. Accordingly, the pin 322 is configured to translate along a length 326 of the slot 324 illustrated in FIG. 16, wherein an engagement member 328 of FIGS. 15A and 15B slidingly contacts the slot along its length, therein generally preventing a rotation of the shaft 234 about the axis 206. The engagement member 328, for example, is configured to rotate about the pin 322. In another example, the shaft 234 and the second portion 216 of the bore 204 have a generally rectangular cross-section when viewed along the axis 206 (e.g., the second and third geometries 232, 236), wherein the anti-rotation apparatus 322 is generally defined by the sliding engagement between the shaft and the second portion of the bore. One or more sensors 330 illustrated in FIG. 2, for example, are further provided and configured to detect a position of the shaft 234 with respect to the housing 202, such as the retracted position 286 of FIG. 15A and extended position 288 of FIG. 15B.

One clear advantage of the present disclosure is that a significant actuation force can be applied to the shaft via the rectangular piston with rounded corners, while minimizing the overall width of the linear actuator 100 of FIG. 2 and the linear actuator 200 of FIGS. 15A, 15B. Furthermore, by providing the at least two o-rings within a singular groove of the piston, the actuation force can be reliably increased over conventional actuators while providing redundancy and ease of maintenance, thus also decreasing manufacturing costs. As such, the overall width of the linear actuators 100 and 200 can be minimized while proficiently providing superior actuation forces in a way that has not been seen heretofore.

Although the invention has been shown and described with respect to certain aspects, equivalent alterations and modifications will occur to others skilled in the art upon the reading and understanding of this specification and the annexed drawings. In particular regard to the various functions performed by the above described components (systems, devices, assemblies, etc.), the terms used to describe such components are intended to correspond, unless otherwise indicated, to any component which performs the specified function of the described component (i.e., that is functionally equivalent), even though not structurally equivalent to the disclosed structure that performs the function in the herein illustrated exemplary aspects of the invention. In addition, while a particular feature of the invention may have been disclosed with respect to only one of several aspects, such feature may be combined with one or more other features of the other aspects as may be desired and advantageous for any given or particular application. Furthermore, to the extent that the term "includes" is used in either the detailed description or the claims, such term is intended to be inclusive in a manner similar to the term "comprising."

What is claimed:

1. A linear actuator, comprising:

a housing having a bore extending therethrough, wherein a first portion of the bore extends a first distance into the housing from a first end thereof, and wherein a second portion of the bore extends a second distance into the housing from a second end thereof, wherein the first portion has a first geometry when viewed from the first end, and wherein the second portion has a second geometry when viewed from the second end, wherein the second geometry is polygonal with substantially rounded corners, and wherein a first interior surface of the second portion of the bore comprises a substantially planar first bearing surface;

a shaft having an axis associated therewith, wherein the shaft has a third geometry when viewed along the axis, and wherein the shaft is in sliding engagement with the first portion of the bore;

a piston member operatively coupled to the shaft, the piston member having a fourth geometry when viewed along the axis of the shaft, wherein the fourth geometry is polygonal with substantially rounded corners, and wherein the piston member is in sliding engagement with the first interior surface of the second portion of the bore;

an anti-rotation apparatus associated with one or more of the piston member and the shaft, wherein the anti-rotation member generally prevents a rotation of the shaft with respect to the housing, and wherein the anti-rotation apparatus comprises an anti-rotation member having a fifth geometry associated therewith when viewed along the axis of the shaft, wherein the fifth geometry is generally D-shaped, wherein a substantially planar anti-rotation bearing surface is defined between two substantially rounded corners of the anti-rotation member, and wherein contact between the anti-rotation member and the housing primarily exists along a sliding engagement between the first interior surface of the second portion of the bore and the anti-rotation bearing surface, therein generally preventing a rotation of the shaft with respect to the housing.

2. The linear actuator of claim 1, wherein the second and fourth geometries are square with substantially rounded corners.

3. The linear actuator of claim 1, wherein the piston member comprises a sealing member operatively coupled to a perimeter of the piston member, wherein an interface between the sealing member and the first interior surface generally defines a sliding seal between the piston member and the housing.

4. The linear actuator of claim 3, wherein the sealing member comprises a generally resilient o-ring.

5. The linear actuator of claim 1, wherein the piston comprises a groove about a periphery thereof, and wherein at least two o-rings are sequentially positioned along the axis within the groove and generally abutting one another, wherein the at least two o-rings are in sliding engagement with the first portion of the bore, and wherein the at least two o-rings substantially seal a variable volume defined by the piston and the first interior surface.

6. The linear actuator of claim 5, wherein each of the at least two o-rings has a generally circular cross-section in a relaxed state.

7. The linear actuator of claim 6, wherein the groove is generally defined by a groove width running generally parallel to the axis and a groove depth running generally perpendicular to the axis, and wherein each of the at least two o-rings has a cross-sectional diameter greater than the groove depth, and wherein the groove width is associated with a sum of the cross-sectional diameters of each of the at least two o-rings.

8. The linear actuator of claim 7, wherein the groove width is greater than or equal to the sum of the cross-sectional diameters of each of the at least two o-rings.

9. The linear actuator of claim 7, wherein the cross-sectional diameter of each of the at least two o-rings is generally equal.

10. A linear actuator, comprising:

a housing having a bore extending therethrough, wherein a first portion of the bore extends a first distance into the housing from a first end thereof, and wherein a second portion of the bore extends a second distance into the housing from a second end thereof, wherein the first portion has a first geometry when viewed from the first end, and wherein the second portion has a second geometry when viewed from the second end, wherein the second geometry is polygonal with substantially rounded corners, and wherein a first interior surface of the second portion of the bore comprises a substantially planar first bearing surface;

a shaft having an axis associated therewith, wherein the shaft has a third geometry when viewed along the axis, and wherein the shaft is in sliding engagement with the first portion of the bore;

a piston member operatively coupled to the shaft, wherein the piston member comprises a groove about a periphery thereof, the piston member having a fourth geometry when viewed along the axis of the shaft, wherein the fourth geometry is polygonal with substantially rounded corners, and wherein the piston member is in sliding engagement with the first interior surface of the second portion of the bore, and wherein the piston member comprises a sealing member operatively coupled to a perimeter of the piston member, wherein an interface between the sealing member and the first interior surface generally defines a sliding seal between the piston member and the housing, wherein the sealing member comprises at least two generally resilient o-rings, and wherein the at least two o-rings are sequentially positioned along the axis within the groove and generally abutting one another, wherein the at least two o-rings are in sliding engagement with the first portion of the bore, and wherein the at least two o-rings substantially seal a variable volume defined by the piston and the first interior surface, and wherein each of the at least two o-rings has a generally circular cross-section in a relaxed state, wherein one of the at least two o-rings has a cross-sectional diameter that is greater than the cross-sectional diameter of the remaining of the at least two o-rings; and an anti-rotation apparatus associated with one or more of the piston member and the shaft, wherein the anti-rotation member generally prevents a rotation of the shaft with respect to the housing.

11. The linear actuator of claim 10, wherein the first and third geometries are a generally circular.

12. The linear actuator of claim 11, wherein the anti-rotation apparatus comprises a pin operatively coupled to the shaft and a slot defined in the first portion of the bore, wherein the slot is generally parallel to the axis, and wherein the pin is configured to translate along a length of the slot, therein generally preventing a rotation of the shaft about the axis.

13. A linear actuator, comprising:

a housing having a bore extending therethrough, wherein a first portion of the bore extends a first distance into the housing from a first end thereof, and wherein a second portion of the bore extends a second distance into the housing from a second end thereof, wherein the first portion has a first geometry when viewed from the first end, and wherein the second portion has a second geometry when viewed from the second end, wherein the second geometry is polygonal with substantially rounded corners, and wherein a first interior surface of the second portion of the bore comprises a substantially planar first bearing surface;

a shaft having an axis associated therewith, wherein the shaft has a third geometry when viewed along the axis, and wherein the shaft is in sliding engagement with the first portion of the bore;

a piston member operatively coupled to the shaft, the piston member having a fourth geometry when viewed along the axis of the shaft, wherein the fourth geometry is polygonal with substantially rounded corners, and wherein the piston member is in sliding engagement with the first interior surface of the second portion of the bore;

an anti-rotation apparatus associated with one or more of the piston member and the shaft, wherein the anti-rotation member generally prevents a rotation of the shaft with respect to the housing, and wherein the shaft and the first portion of the bore have a generally rectangular cross-section when viewed along the axis, and wherein the anti-rotation apparatus is generally defined by the sliding engagement between the shaft and the second portion of the bore.

14. The linear actuator of claim 13, wherein the piston comprises a groove about a periphery thereof, and wherein at least two o-rings are sequentially positioned along the axis within the groove and generally abutting one another, wherein the at least two o-rings are in sliding engagement with the first portion of the bore, and wherein the at least two o-rings substantially seal a variable volume defined by the piston and the first interior surface.

15. The linear actuator of claim 14, wherein each of the at least two o-rings has a generally circular cross-section in a relaxed state.

16. The linear actuator of claim 14, wherein the groove is generally defined by a groove width running generally parallel to the axis and a groove depth running generally perpendicular to the axis, and wherein each of the at least two o-rings has a cross-sectional diameter greater than the groove depth, and wherein the groove width is associated with a sum of the cross-sectional diameters of each of the at least two o-rings.

17. The linear actuator of claim 16, wherein the cross-sectional diameter of each of the at least two o-rings is generally equal.

18. A linear actuator, comprising:

a housing having a bore extending therethrough, wherein a first portion of the bore extends a first distance into the housing from a first end thereof, and wherein a second portion of the bore extends a second distance into the housing from a second end thereof, wherein the second portion of the bore has a rectangular geometry having two pairs of parallel opposing sides with substantially rounded corners therebetween when viewed from the second end;

a shaft having an axis associated therewith, wherein the shaft is in sliding engagement with the first portion of the bore;

a piston member operatively coupled to the shaft, the piston member having a rectangular geometry with substantially rounded corners when viewed along the axis of the shaft, and wherein the piston member is in sliding engagement with a first interior surface of the second portion of the bore; and an anti-rotation apparatus associated with one or more of the piston member and the shaft, wherein the anti-rotation member generally prevents a rotation of the shaft with respect to the housing.

19. The linear actuator of claim 18, further comprising a sensor configured to detect a position of the shaft with respect to the housing.

20. The linear actuator of claim 18, further comprising an end cap operatively coupled to the housing, wherein the end cap generally encloses second portion of the bore.

21. The linear actuator of claim 18, wherein the piston member comprises a groove about a periphery thereof, and wherein at least two o-rings are sequentially positioned along the axis within the groove, wherein the at least two o-rings generally abut one another, and wherein the at least two o-rings are in sliding engagement with the first portion of the bore, wherein the at least two o-rings substantially seal a variable volume defined by the piston and the first interior surface.

22. The linear actuator of claim 21, wherein each of the at least two o-rings has a generally circular cross-section in a relaxed state.

23. The linear actuator of claim 21, wherein the groove is generally defined by a groove width running generally parallel to the axis and a groove depth running generally perpendicular to the axis, and wherein each of the at least two o-rings has a cross-sectional diameter greater than the groove depth, and wherein the groove width is associated with a sum of the cross-sectional diameters of each of the at least two o-rings.

24. The linear actuator of claim 23, wherein the cross-sectional diameter of each of the at least two o-rings is generally equal.

25. The linear actuator of claim 18, wherein the piston member comprises a sealing member operatively coupled to a perimeter of the piston member, wherein an interface between the sealing member and the first interior surface generally defines a sliding seal between the piston member and the housing.

26. The linear actuator of claim 25, wherein the sealing member comprises a generally resilient o-ring.

27. The linear actuator of claim 18, wherein the anti-rotation apparatus comprises an anti-rotation member having a generally D-shaped geometry associated therewith when viewed along the axis of the shaft, wherein a substantially planar anti-rotation bearing surface is defined between two substantially rounded corners of the anti-rotation member, and wherein contact between the anti-rotation member and the housing primarily exists along a sliding engagement between the first interior surface of the second portion of the bore and the anti-rotation bearing surface, therein generally preventing a rotation of the shaft with respect to the housing.

28. The linear actuator of claim 18, wherein the anti-rotation apparatus comprises a pin operatively coupled to the shaft and a slot defined in the first portion of the bore, wherein the slot is generally parallel to the axis, and wherein the pin is configured to translate along a length of the slot, therein generally preventing a rotation of the shaft about the axis.

29. The linear actuator of claim 13, wherein the piston member comprises a sealing member operatively coupled to a perimeter of the piston member, wherein an interface between the sealing member and the first interior surface generally defines a sliding seal between the piston member and the housing.

30. The linear actuator of claim 29, wherein the sealing member comprises a generally resilient o-ring.

* * * * *